US007324767B2

(12) United States Patent
Martin et al.

(10) Patent No.: US 7,324,767 B2
(45) Date of Patent: Jan. 29, 2008

(54) SYSTEMS AND METHODS FOR DIAGNOSING COLOR IMAGE FORMING DEVICES

(75) Inventors: Michael J. Martin, Hamlin, NY (US); Debbie S. Wickham, Victor, NY (US); Shawn P. Updegraff, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 891 days.

(21) Appl. No.: 10/742,937

(22) Filed: Dec. 23, 2003

(65) Prior Publication Data

US 2005/0135821 A1 Jun. 23, 2005

(51) Int. Cl.
*G03G 15/00* (2006.01)

(52) U.S. Cl. ..... 399/49; 399/50

(58) Field of Classification Search ..... 399/49, 399/50, 51, 162

See application file for complete search history.

(56) References Cited

U.S. PATENT DOCUMENTS 5,313,259 A * 5/1994 Smith ..... 399/76
6,275,244 B1 8/2001 Omelchenko et al.
6,889,021 B2 * 5/2005 Lin et al. ..... 399/162

FOREIGN PATENT DOCUMENTS

EP 0 602 853 A2 12/1993
WO WO 2004/029728 A1 4/2004

* cited by examiner

*Primary Examiner*—David M. Gray
*Assistant Examiner*—Erika Villaluna
(74) *Attorney, Agent, or Firm*—Oliff & Berridge, PLC

(57) ABSTRACT

A diagnostic routine for determining the cause of color non-uniformity in a full color image forming device, by selecting a substation of one print station and using it in combination with a substation from another print station, while functionally omitting the intervening substations. The charge setting on the charge substation is adjusted to compensate for the increased distance between the charge substation, and the developing substation in this method.

48 Claims, 4 Drawing Sheets

SYSTEMS AND METHODS FOR DIAGNOSING COLOR IMAGE FORMING DEVICES

BACKGROUND OF THE INVENTION

1. Field of Invention

This invention relates to systems and methods for generating color images.

2. Description of Related Art

In electrophotographic printing, a photoconductive surface is charged and is then selectively exposed to image data to selectively discharge portions of the charged photoconductive surface. This forms a latent electrostatic image on the photoconductive surface. Charged toner material is then applied to the latent image bearing portion of the photoconductive surface to convert the latent electrostatic image into a developed image. Finally, the developed, or toner, image is transferred to a sheet of recording material, such as paper, by charging the backside of the paper to attract the toner of the developed image from the photoconductive surface to the paper. The developed, or toner, image is then at least semi-permanently fixed to the sheet of recording material, such as, for example, by heating a thermoplastic toner material to fuse it to the sheet of recording material. An example of this process is more fully described in U.S. Pat. No. 2,297,691.

In full color image-on-image systems, this process is repeated a number of times to build a multilayer full-color image. In the image-on-image technique, a first latent image is developed onto a portion of the photoconductive surface. Subsequent latent images are exposed through the first image, on the same portion of the photoconductive surface, and then developed.

In image-on-image systems, different color features of an input image are formed at separate print stations of the image forming device. Therefore, each print station is responsible for processing one of a number of different colors, such as, for example, magenta, yellow, cyan or black. Each print station typically contains three substation components: a charging substation, an exposing substation, and a developing substation. These stations and their substations are arranged serially around the photoconductive surface. Thus, in such image forming devices, the photoconductive surface is often a photoreceptor belt. The photoreceptor belt moves past these different substations at a speed that allows adequate time for: (1) uniform charging of the photoconductive surface, (2) sufficient exposure of the latent image, and (3) sufficient developing of the image.

Commercial demands require that these devices operate reliably and that any downtime associated with maintaining the device be minimized. In particular, color non-uniformity, or more formally the within-page color variation, is a key performance attribute which nearly every customer lists as critical for their printing business. Within-page color non-uniformity is the variation that occurs within a given cut sheet size image and is typically due to within-page density variations in the form of streaks and bands. Sources of the within-page color variations are numerous, and can be caused by the charging substations, the exposing substations, the developer substation, the photoreceptor belt module, and/or the transfer substation.

SUMMARY OF THE DISCLOSURE

It is often difficult to isolate which of the substations for a given color layer, the charging substation, the exposing substation, or the developer substation, is responsible for a given within-page color variation, resulting in long service calls and/or misdiagnoses, which drive up service costs. Therefore, identifying problems related to any of these substations mentioned above, such as, for example, the charging substation, the exposing substation and/or the developing substation, should be done rapidly and the faulty component be quickly replaced.

Current xerographic printers use multiple print stations, where the substation components are essentially duplicated from one print station to the next. In typical systems, these substations are arrayed serially around the photoreceptor belt module and offer a diagnostic capability that greatly enhances the ability to isolate the root cause of a color uniformity problem. For example, the function of a given substation component can be accomplished by the corresponding substation component in a different print station. For example, if a problem exists in the yellow developing substation, the cyan or black developing substation can be used to develop the latent image charged at the yellow charging substation and exposed at the yellow exposing substation.

In particular, the inventors have recognized that, by choosing various xerographic substation components from upstream and downstream printer stations, a service engineer can quickly isolate the root cause of a color uniformity problem in a given color, by using combinations of the substations that either delete or select the suspected faulty device. For example, if the yellow color separation layer has a color uniformity problem, the service engineer can generate test images using the magenta charging substation, the yellow exposing substation and the cyan developing substation. If that does not isolate the problem, additional test images can then be generated using the magenta charging and exposing substations and the yellow developing substation, and/or using the yellow charging substation, and the cyan exposing and developing substations, to identify whether the problem is in the yellow charging, exposing and/or developing substations. Stations or substations that are not being used can be functionally omitted from the intervening print stations to isolate and identify the faulty device.

This invention provides systems and methods for selectively omitting various components of a print station to locate a root cause of a color uniformity problem in a full color image forming device.

This invention separately provides systems and methods for adjusting charging substation settings to compensate for variations in spacing between a charging substation and a developing substation.

In various exemplary embodiments, systems and methods according to this invention diagnose an image forming device by disabling various substations along the photoreceptor belt. However, functionally removing one or more intervening substations results in an increased interval between the charging substation that charges the photoreceptor belt, the exposing substation that creates the latent image, and/or the developing substation that develops the exposed image. This larger delay can allow leakage of charge from the photoreceptor belt, in a phenomenon known as "dark decay." Accordingly, the charge remaining on the photoreceptor belt after a given interval, due to the dark decay, is less than the charge initially applied to the photoreceptor belt.

Thus, when using substations from multiple print stations, it is advantageous to measure the charge remaining on the photoreceptor belt at the exposing and/or developing substations of one or more of the downstream print station(s), and to adjust the charge applied to the photoreceptor belt at a charging substation of an upstream print station to compensate for the increased loss of charge due to the larger interval that the dark decay is able to operate over. By measuring the remaining charge at the devices of the downstream print station(s) and adjusting the charging substation accordingly, the residual photoreceptor belt charge at the exposing and/or developing substations can be maintained at a predetermined level, despite changes in the location of the exposing and/or developing substations relative to the charging substation.

In various other exemplary embodiments, systems and methods according to this invention diagnose an image forming device by measuring the residual charge on the photoreceptor belt at the developing substation, as a function of charge settings applied to the charging substation. In various exemplary embodiments, the diagnostic procedure includes a linear interpolation that relates the measured charge on the photoreceptor belt to the charge settings applied to the charging substation. Different values of the charge setting are measured, depending on the varying distance between the charging substation and the exposing and/or developing substations.

These and other features and advantages of this invention are described in, or are apparent from, the following detailed description of various exemplary embodiments of systems and methods according to this invention.

BRIEF DESCRIPTION OF THE DRAWINGS

Various exemplary embodiments of systems and methods according to this invention will be described in detail, with reference to the following figures, wherein:

FIG. 1 is a block diagram outlining elements of the various exemplary embodiments of an image forming device that the diagnostic techniques according to this invention are usable with;

DETAILED DESCRIPTION OF EXEMPLARY EMBODIMENTS

Figure 1:
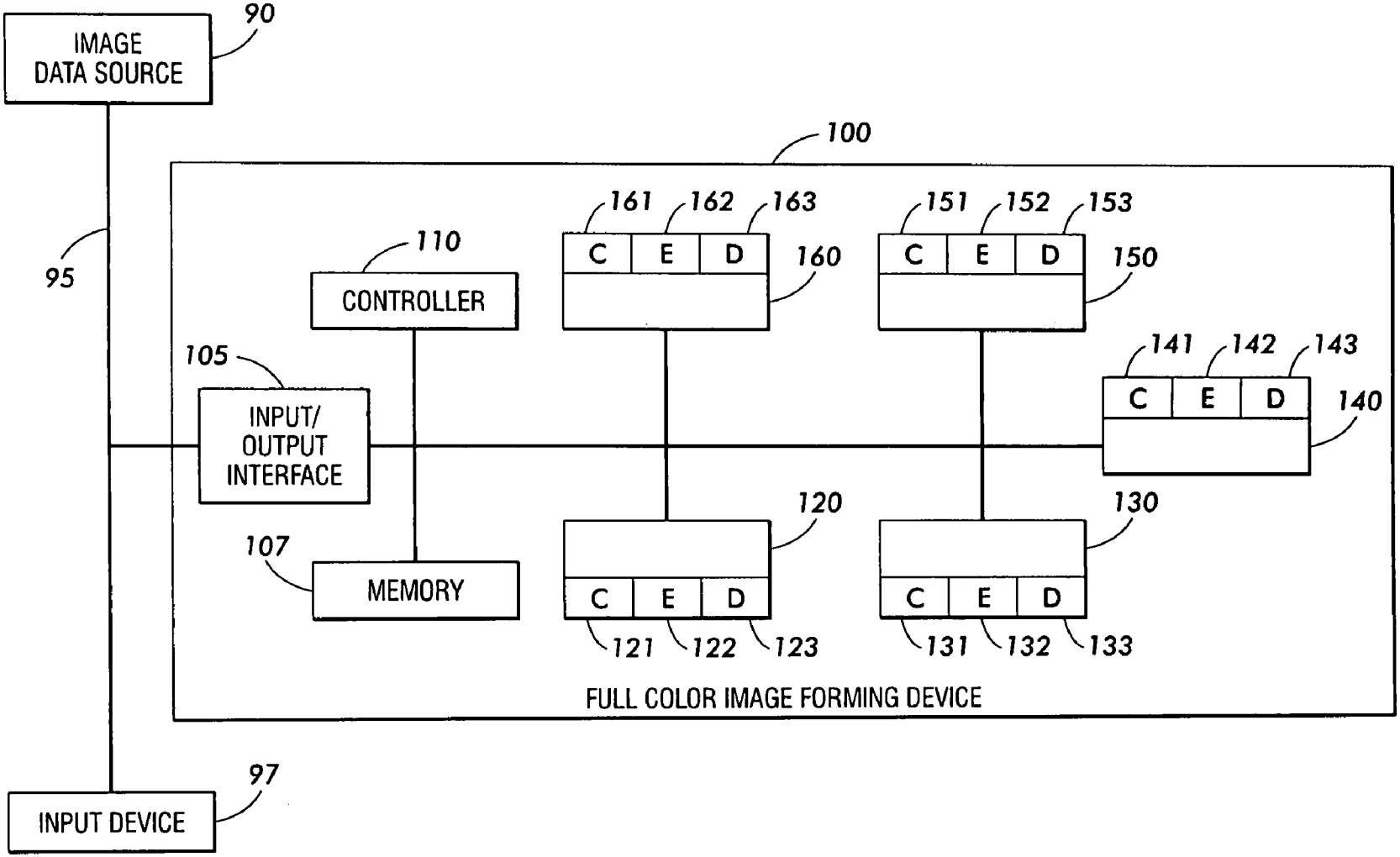

FIG. 1 is a generalized block diagram of a known full color image forming device 100. The full color image forming device 100 is connectible to an image data source 90 over a signal line or link 95. The image data source 90 provides input data to the full color image forming device 100.

The image data source 90 can provide a test pattern to be used in the diagnostic procedure to the full color image forming device 100. Alternatively, the test pattern may be stored in a memory 107 of the full color image forming device 100. The controller 110 can subsequently load the test data from the memory 107 to the appropriate substation. The controller 110 accepts input from the input device 97, via input/output interface 105. The input device 97 will input to the controller a group of selected print substations, where the selected print substations are a subset of those available. The selected print substations that will form the image-forming path for the generation of a set of test images, which will indicate the source of a color uniformity problem in the image forming path. The selection of the groups will be described more fully below.

The memory 107 can be implemented using any appropriate combination of alterable, volatile or non-volatile, memory; or non-alterable or fixed memory. The alterable memory, whether volatile or non-volatile, can be implemented using any one or more of static or dynamic RAM, a floppy disk and disk drive, a writable or rewritable optical disk and disk drive, a hard drive, flash memory or the like. Similarly, the non-alterable or fixed memory can be implemented using any one or more of ROM, PROM, EPROM, EEPROM, an optical ROM disk such as a CD-ROM or DVD-ROM disk or disk drive or the like.

It should be appreciated that the test image data can be generated by scanning an image on an original physical document. Alternatively, the test image data could have been generated at any time in the past. The electronic test image data need not have been generated from a physical document, but could have been created from scratch electronically. The test image data source 90 is thus any known or later developed device that is capable of supplying electronic image data over the link 95 to the full color image forming device 100. The link 95 can thus be any known or later developed system or device for transmitting the electronic image data from the image data source 90 to the full color image forming device 100.

In various exemplary embodiments, the full color image forming device 100 prints a full color image using, for example, magenta, yellow, cyan and black toner in separated layers. The four color separation layers are typically generated separately using the color separation generating stations 120-160. Each of the color separation layer generating stations 120-160 includes a charging substation (C) 121-161, respectively, an exposing substation (E) 122-162, respectively, and a developing substation (D) 123-163, respectively. In the exemplary image forming device 100 shown in FIG. 1, while the image forming device 100 generally creates four different color separation layers, the image forming device 100 includes five color separation generation stations. This is done to accommodate an optional fifth color. The fifth station 160 is reserved for the optional fifth color, whereas the stations 120-150 generate, for example, the magenta, yellow, cyan and black color separation layers, respectively.

In various exemplary embodiments, the charging substations 121, 131, 141, 151, and 161 each include, for example, a grid made of electrically conductive wires, which are charged to a certain potential. At this operating potential, electrons are ejected from the grid, and accelerated away from the grid and toward the electrically neutral charge-retentive photoconductive surface. Any of a number of different charge-depositing devices, mechanisms or systems may be used in the charging stations 121-161.

In various exemplary embodiments, the exposing substations 122, 132, 142, 152 and 162 include a light source, which is often a laser, that illuminates the charge-retentive surface with light, causing a photoconductive path to be formed through the thickness of the charge-retentive surface to an underlying conductor. The exposing substations 122-162 may include a raster output scanner (ROS), in which a laser beam is swept left to right across the image at a relatively high speed, as the photoreceptive belt moves along a generally orthogonal direction at a slower speed, to form each pixel in the image. Alternatively, the exposing substations 122-162 may include a full-width print bar. The illumination light from the raster output scanner is modulated to selectively discharge areas of the photoreceptive belt to form a latent electrostatic image on the charge-retentive surface.

The developing substations 123, 133, 143, 153, and 163 apply charged toner material to the charge-retentive surface. The toner material adheres differently to the charged areas compared to the uncharged areas, which were discharged by exposure to the illumination light of the exposing substation.

Each of the component substations, the charging substations 121-161, the exposing substations 122-162, and the developing substations 123-163, is subject to malfunctions that can affect output image quality. For example, a particular one of the charging substations 121-161 may not deliver charge evenly across the charge-retentive surface, causing streaks and other color non-uniformity problems. Other failure modes for the charging substation include physical damage to the grid device, contamination of the wire or grid device, part defects or part failure due to age or wear. Similarly, the other substations may fail by contamination, part failure or wear.

Figure 2:
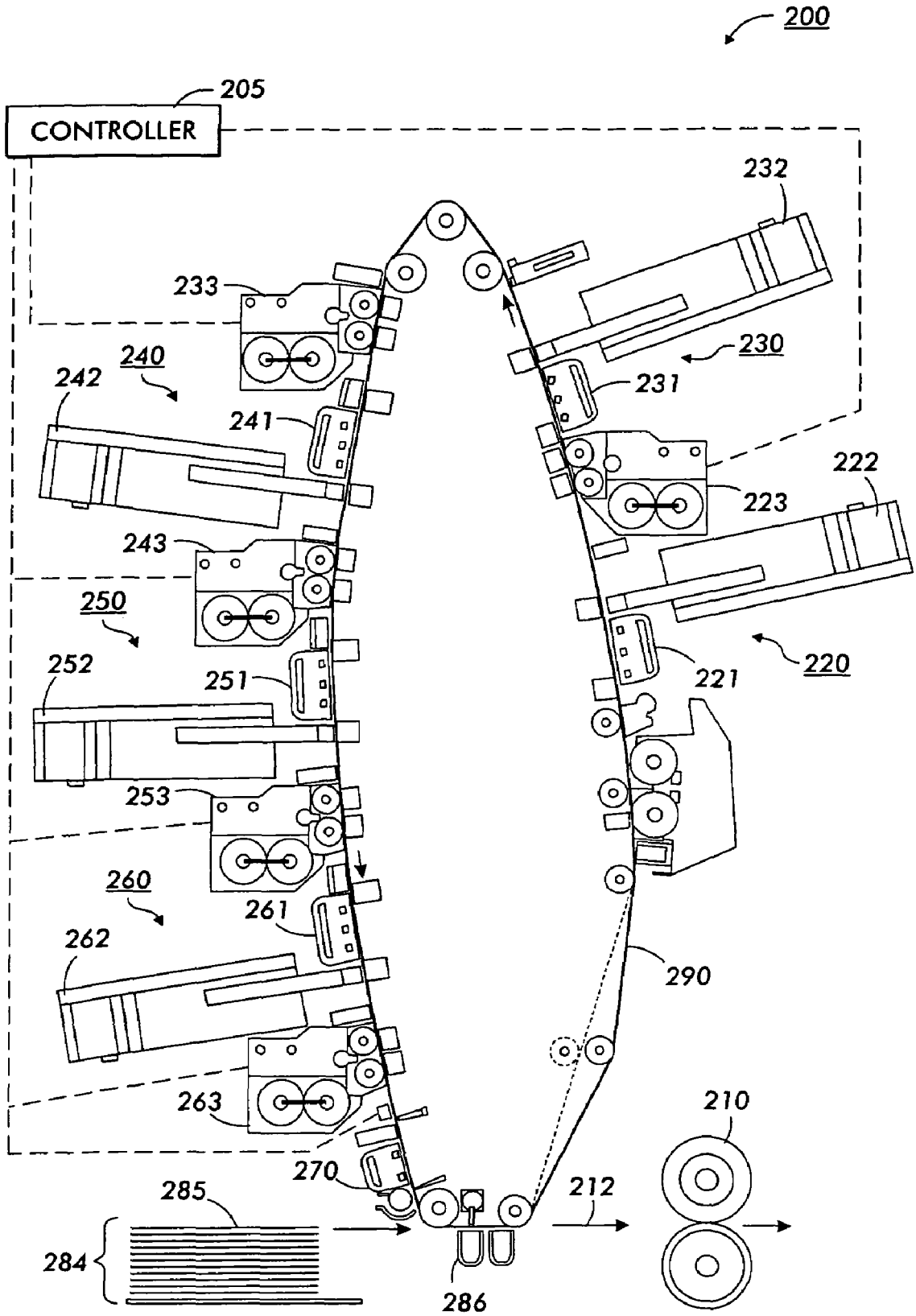
FIG. 2 is a schematic diagram of an exemplary embodiment of the full color image device of FIG. 1.

FIG. 2 is a schematic diagram of one exemplary embodiment of a full color image forming device 200. As shown in FIG. 2, the photoreceptor belt 290 moves, in a counterclockwise direction, past the various print stations 220, 230, 240, 250 and 260 that are located along the circumference of the photoreceptor belt 290. In normal operation, the photoreceptor belt 290 moves between the various print stations by first moving past a first charging substation 221 of the first print station 220. The charging substation 221 charges a portion of the photoreceptor belt 290. In various exemplary embodiments, the speed of the photoreceptor belt 290 past the charging substation 221 is determined to allow the portion of the photoreceptor belt 290 to be uniformly charged.

The charged portion of the photoreceptor belt 290 then travels past an exposing substation 222 of the first print station 220. The exposing substation 222 exposes the charged portion of the photoreceptor belt, based on provided image data to form a latent electrostatic image on that portion of the photoreceptor belt 290. In various exemplary embodiments, the speed of the photoreceptor belt 290 is determined to allow proper operation of a raster output scanner on the photoreceptor belt 290.

The exposed portion of the photoreceptor belt 290 then travels past a developing substation 223 of the first print station 220. The developing substation 223 develops the latent electrostatic image on the exposed portion of the photoreceptor belt 290 to form a first color toner image. The speed of the photoreceptor belt is such that sufficient development time of the first color toner image is provided.

The photoreceptor belt continues to move, in a counterclockwise direction, past the second print station 230. A second charging substation 231 of the second print station 230 re-charges the developed portion of the photoreceptor belt 290 on which the first color toner image has been formed. The re-charged photoreceptor belt 290 then travels past a second exposing substation 232. The second exposing substation 232 exposes the re-charged portion of the photoreceptor belt 290 through the previously developed toner image. The re-exposed portion of the photoreceptor belt 290 then travels past a second developing substation 233 of the second print station 230. The second developing substation 233 develops the re-exposed portion of the photoreceptor belt 290 to form second color toner image on top of the first toner image.

The photoreceptor belt continues to move, in a counterclockwise direction, past the third print station 240. A third charging substation 241 of the third print station 240 again re-charges the photoreceptor belt 290. The charged photoreceptor belt 290 travels past the charging substation 241 to a third exposing substation 242 of the third print station 240. The third exposing substation 242 again re-exposes a portion of the photoreceptor belt 290, through the two previously developed toner images. The re-exposed portion of the photoreceptor belt 290 then travels past a third developing substation 243 of the third print station 240. The third developing substation 243 develops the third color toner image.

The photoreceptor belt continues to move, in a counterclockwise direction, to the fourth print station 250. A fourth charging substation 251 of the fourth print station 250 again re-charges the photoreceptor belt 290. The charged photoreceptor belt 290 then travels to a fourth exposing substation 252 of the fourth-print station 250. The exposing substation 252 exposes a portion of the photoreceptor belt 290 through the three previously exposed toner images. The exposed portion of the photoreceptor belt 290 then travels past a fourth developing substation 253 of the fourth print station. The fourth developing substation 253 develops the fourth color toner image.

The photoreceptor belt 290 continues to move, in a counterclockwise direction, to the fifth print station 260. If a fifth color is implemented, a charging substation 261 of the fifth print station 260 charges the photoreceptor belt 290. The charged photoreceptor belt 290 then travels past a fifth exposing substation 262 of the fifth print station 260. The fifth exposing substation 262 exposes a portion of the photoreceptor belt 290 through the four previously exposed toner images. The exposed portion of the photoreceptor belt 290 then travels past a fifth developing substation 263 of the fifth print station 260. The developing substation 263 develops the fifth color toner image. Of course, it should be appreciated that, if a fifth color is not implemented, the fifth print station does not operate as the developed portion of the photoreceptor belt 290 moves past. It should also be appreciated that, if a fifth color is not implemented, the non-operative print station need not be the fifth print station 260. Rather, the non-operative print station could be any one of the first-fourth print stations 220-250. In this case, the fifth print station 260 is used.

After developing the fourth toner image, or, if implemented, the fifth toner image, the photoreceptor belt 290 continues to move, in a counterclockwise direction, past a pretransfer station 270. The pretransfer station 270 prepares the full color image to be transferred to a recording material 285 at a transfer station 286. The recording material 285 may be paper, and is fed by the recording material housing 284 to the transfer station 286, where the image is transferred from the developed portion of the photoreceptor belt 290 to the recording material 285. The recording material 285 then moves in a direction of 212 to a fixing station 210. In various exemplary embodiments, the toner material used in the developing substations 223, 233, 243, 253, and/or 263 is a thermoplastic material that melts upon heating. In such exemplary embodiments, the image is permanently or semi-permanently fixed to the recording material 285 in the fixing station 210. The fixing station 210 receives the recording material 285 and fixes the color toner image to the recording material 285 at least semi-permanently, for example, by melting the toner image into the recording material 285.

In various exemplary embodiments of the diagnostic systems and methods according to this invention, one or more substations of one or more print stations are functionally removed from the path described above in relation to FIG. 2, to isolate the source of a color uniformity problem. A set of at least three substations, a charging substation, an exposing substation, and a developing substation, is required to produce a test image. Because each of the three substations, the charging substation, the exposing substation and the developing substation is functionally equivalent in each of the print stations 120-160, any set of at least three substations can be used to produce an image for a single color separation layer. For example, a magenta charge station can be used, along with a yellow exposing station and a cyan developing station, to generate a single cyan-colored image. Therefore, by carefully selecting a set of at least one charging substation, at least one exposing substation and at least one developing substation, a substation which is expected to be the cause of a color uniformity problem, can be isolated and identified.

For example, a service engineer may be called to evaluate a customer complaint about a color shift in a green halftone. Since green is formed by combining the yellow and cyan color separation layers, the service engineer first determines which of the two color separation layers is responsible for the defect. The service engineer typically determines this by printing a full-page halftone of each color. Based on the quality of the images of each color, the service engineer may determine whether the problem exists in the yellow color separation layer or the cyan color separation layer. In this example, the service engineer determines that the problem is with the yellow color separation layer.

If, for example, the yellow color separation layer is formed using the second print station 230 the service engineer then proceeds to diagnose which substation 231-233 is responsible for the color uniformity problem. If the service engineer suspects that the yellow charging substation 231 is responsible for the problem, the service engineer can eliminate the yellow charge substation 231 from the image-producing path by selecting another upstream charging substation to operate with the yellow exposing and developing substations 232 and 233. If, for example, the first print station 220 is the magenta color separation layer, the magenta charging station 221 can operate with the yellow exposing substation 232 and yellow developing substation 233 to form the yellow color separation layer. Therefore, test images formed by this set of substations should not show the defect.

If, however, the service engineer suspects that the problem is with the yellow exposing substation 232, the service engineer can choose a set of substations to form the yellow color separation layer which does not include the yellow exposing substation 232. For example, the yellow color separation layer can be formed using the magenta charging substation, the magenta exposing substation 222 and the yellow developing substation 233. If the yellow exposing substation 232 is indeed responsible, the defect should not be apparent in the test images produced by this set of substations.

If, however, the service engineer suspects that the yellow developing substation 233 is responsible for the defect, the service engineer can choose a set of substations to form the yellow color separation layer which does not include the yellow developing substation. If, for example, the third print station 240 is used to form the cyan color separation layer, the yellow color separation layer can be formed using, for example, the yellow charging substation 231, the yellow exposing substation 232 and the cyan developing substation 243. If the yellow developing substation 233 is indeed responsible for the defect, the defect should not be apparent in the test images produced by this set of substations.

The service engineer may then confirm that the faulty device has been correctly identified, by including the identified faulty substation in the selected set to produce one or more confirmation images. For example, if the faulty device is identified as the yellow charging substation 231, the service engineer may select the yellow charging substation 231, the cyan exposing substation 242, and the cyan developing substation 243. If the faulty device has been correctly identified as the yellow charging substation 231, the defect should appear in the confirmation images produced by this set of substations. If the problem is suspected to be caused by the yellow exposing substation 232, producing confirmation images using the magenta charging substation 221, the yellow exposing substation 232 and the cyan developing substation 243 should confirm the identification of the yellow exposing substation as the faulty device. If the problem is suspected to be caused by the yellow developing substation 233, producing images using the magenta charging substation 221, the magenta exposing substation 222, and the yellow developing substation 233 should confirm the identification of the yellow developing substation 233 as the faulty device.

Therefore, in various exemplary embodiments, at least three substations are chosen from among the available substations of the implemented print stations, and this choice of at least three substations constitutes a "test set" of substations that will be used to produce the test images. The other, unselected, substations are functionally omitted from the image-forming path. Each selected test set of at least one charging substation, at least one exposing substation, and at least one developing substation corresponds to a single test set. Table 1 lists exemplary test sets when the first-fourth print stations 220-250 form the magenta (M), yellow (Y), cyan (C) and black (K) color separation layers, respectively. In various exemplary embodiments, a plurality of these test sets are selected, and the selected test sets are used by the image forming device 200 to form test color separation layer images. The specific selected sets are chosen to quickly and efficiently isolate the cause of a color uniformity problem, by sequentially omitting and re-introducing various substations along the image forming path.

In Table 1, each test set corresponds to a specific choice of at least one charging substation, at least one exposing substation and at least one developing substation. Each test set may be used to produce a number of test prints, for example 10, for each test set. Each substation not used by a particular test set is disabled by the controller 205. Test sets 21-23 are used to create color overlay combinations to assist the service engineer to visually assess the performance of the substations in the yellow print stations. These test sets may emphasize defects in a yellow halftone image, because humans tend to have low visual acuity in yellow.

TABLE 1

| Test Set # | Name | Description |
|---|---|---|
| 1 | MMM | Magenta Charge, Magenta Expose, Magenta Developer |
| 2 | MMY | Magenta Charge, Magenta Expose, Yellow Developer |
| 3 | MMC | Magenta Charge, Magenta Expose, Cyan Developer |
| 4 | MMK | Magenta Charge, Magenta Expose, Black Developer |
| 5 | MYY | Magenta Charge, Yellow Expose, Yellow Developer |
| 6 | MYC | Magenta Charge, Yellow Expose, Cyan Developer |
| 7 | MYK | Magenta Charge, Yellow Expose, Black Developer |
| 8 | MCC | Magenta Charge, Cyan Expose, Cyan Developer |
| 9 | MCK | Magenta Charge, Cyan Expose, Black Developer |
| 10 | MKK | Magenta Charge, Black Expose, Black Developer |
| 11 | YYY | Yellow Charge, Yellow Expose, Yellow Developer |
| 12 | YYC | Yellow Charge, Yellow Expose, Cyan Developer |
| 13 | YYK | Yellow Charge, Yellow Expose, Black Developer |
| 14 | YCC | Yellow Charge, Cyan Expose, Cyan Developer |
| 15 | YCK | Yellow Charge, Cyan Expose, Black Developer |
| 16 | YKK | Yellow Charge, Black Expose, Black Developer |
| 17 | CCC | Cyan Charge, Cyan Expose, Cyan Developer |
| 18 | CCK | Cyan Charge, Cyan Expose, Black Developer |
| 19 | CKK | Cyan Charge, Black Expose, Black Developer |
| 20 | KKK | Black Charge, Black Expose, Black Developer |
| 21 | MMMCCC | Magenta Charge, Magenta Expose, Magenta Developer + Cyan Charge, Cyan Expose, Cyan Developer |
| 22 | MMYCCC | Magenta Charge, Magenta Expose, Yellow Developer + Cyan Charge, Cyan Expose, Cyan Developer |
| 23 | MYYCCC | Magenta Charge, Yellow Expose, Yellow Developer + Cyan Charge, Cyan Expose, Cyan Developer |

Upon considering the various test sets shown in Table 1, it is apparent that different distances will exist between the charging substation, the exposing substation used to form the latent image, and the developing substation used to develop the image, depending on the selected test set. For example, when test set 3 is selected, the photoreceptor belt 290 will be charged at the magenta charging substation 221, and exposed at the magenta exposing substation 222. However, the magenta developing substation 223 has been disabled, as have been the yellow charging substation 231, the yellow exposing substation 232, the yellow developing substation 233, the cyan charging substation 241, and the cyan exposing substation 242. When the test set 3 is selected, the charged and exposed image will not be developed until the photoreceptor belt 290 reaches the cyan developing substation 243.

Depending on the choice of test sets, as shown in Table 1, there will be variability in time between charging the portion of the photoreceptor belt 290 and developing the latent image of that portion of the photoreceptor belt 290. Accordingly, some amount of charge may have leaked from the charged portion of the photoreceptor belt due to dark decay. To compensate for this effect, the charge deposited by the selected charging substation, which remains on the photoreceptor belt at each of the downstream exposing and developing substations, is measured using a charge-sensing device, such as an electrostatic voltmeter (ESV). The electrostatic voltmeter is a non-contact instrument that measures the electrostatic voltage produced on an insulating surface as a result of the charge deposited on that surface. This measurement can be used to increase the charge setting on the charge substation to compensate for the loss of charge due to dark decay during the delay between charging and exposing the charged portion of the photoreceptor belt, and developing the exposed latent image.

In general, an electrostatic voltage measurement will be taken at the selected downstream developing substation, to relate the electrostatic voltage remaining at that developing substation to the charge setting used by the selected charging substation when charging the photoreceptor belt 290. However, it should be appreciated that the techniques and procedures described herein can also be used relative to the selected exposing substation, so that the electrostatic voltage remaining on the photoreceptor belt 290 at the selected exposing substation can be measured and related to the charge settings used by the selected charging substation.

In order to improve the charge uniformity of charge on the charge-retentive surface, various exemplary embodiments disclosed herein use a dual recharge system, in which an AC charging device is coupled with a DC charging device to apply charge to the charge-retentive surface. U.S. patent applications U.S. Pat. Nos. 6,970,662 and 7,031,628, each filed on even date herewith and each incorporated by reference in its entirety, disclose in greater detail the structure and operation of such dual charging systems. The DC and AC charging devices are set to given charge levels that cause the charge-retentive surface to be charged to a corresponding level. Precision adjustments can be made using the AC charging device. It should be appreciated that various systems and embodiments according to this invention may be used with dual charging systems that include one or more AC/AC charging device pairs, one or more DC/DC charging device pairs, as well as AC/DC charging device pairs.

The ability of the AC and DC charging devices to charge the charge-retentive surface is based on physical parameters within the particular charging device, such as nominal spacing to the charge-retentive surface, the level of contamination in that charging substation, and the grid voltage used in that charging substation. In addition, the charging performance can be affected by mechanical tolerances, and variations in environmental conditions, such as temperature, humidity and/or the like. Typically, the relationship between the applied grid voltage in that charging substation and the surface charge produced on the charge-retentive surface is linear. In various exemplary embodiments, a voltage-sensing device measures the surface charge on the photoreceptor belt 290 created by a particular charging substation operating at one or more grid voltage levels to determine the slope and offset of the linear relationship between the applied grid voltage and the resulting surface charge.

In various exemplary embodiments, a linear interpolation is then performed between the charge settings that resulted in the measured electrostatic voltages, to determine the charge setting that would result in the target electrostatic voltage. An adjusted charge setting is determined from this linear interpolation. This adjusted charge setting is associated with the corresponding test set. Then, when that test set is selected, this adjusted charge setting is input to the particular charging substation that is used by this test set, so that the appropriate charge level at the particular developing substation used by this test set is obtained.

To compensate for every possible combination of charging substation and developing substation, the charge setting and resulting ESV measurement for each of the possible pairs of charging substation and downstream developing substation is characterized. For example charging substation 221 with developing substations 233, 243, 253 and 263, charging substation 231 with developing substations 243, 253 and 263, and charging substation 241 with developing substation 253 and 263, and charging substation 251 with developing substation 263. Therefore, there are ten possible combinations of a charge substation and downstream developing substation. The relationship between the charge settings and the downstream voltage is used to select the proper charge setting for the charging substation, depending on which downstream developing substation is to be used by the test set.

In various exemplary embodiments, the diagnostic procedure described above with respect to the hypothetical yellow color uniformity problem, can be implemented using the system shown in FIGS. 1 and 2. To diagnose which of the yellow substations is responsible for the color uniformity problem, the service engineer would select test set 5, corresponding to the magenta charging, yellow exposing and yellow developing substations, along with test set 2, corresponding to the magenta charging, magenta exposing and yellow developing substations, and test set 12, corresponding to the yellow charging, yellow exposing and cyan developing substations. These three test sets are input to the controller 110.

The image-forming path then prints test images corresponding to the three test sets. The printed test images can be analyzed to ascertain which of the yellow substations is responsible for the color uniformity problem. The service engineer then also selects test sets that act as confirmation sets, to confirm that the faulty device had been correctly identified by the previous three diagnostic test set runs. In this exemplary embodiment, the confirmation test sets include test set 14 (yellow charging, cyan exposing and cyan developing substations), test set 6 (magenta charging, yellow exposing and cyan developing substations), and test set 2 (magenta charging, magenta exposing and yellow developing substations).

Having selected the test sets for the diagnostic procedure, the service engineer then selects a test pattern. In various exemplary embodiments, the service engineer chooses a test pattern that tends to highlight the particular color uniformity problem that the image-forming device 100 is experiencing. In various exemplary embodiments, the test pattern may be one of 20%, 50% or 70% halftone area coverage. The test images files may be loaded from memory, or they may be input from an image data source, such as the image data source 90 shown in FIG. 1. The image data source may be a scanner that scans an input test pattern from a document supplied by the service engineer, for example.

Each of the test sets is selected one at a time, and the print substations not used in the selected test set are disabled. A desired charge setting is applied to the selected charging substation, based on which developing substation is being used by the test set. A number of test prints, such as, for example ten test prints, is selected to be generated by the image-forming path defined by each of these six test sets. The service engineer then observes the generated images to detect the presence or absence of the image defect. Alternatively, the printed test images can be automatically analyzed to detect the presence or absence of the image defect.

Figure 3:
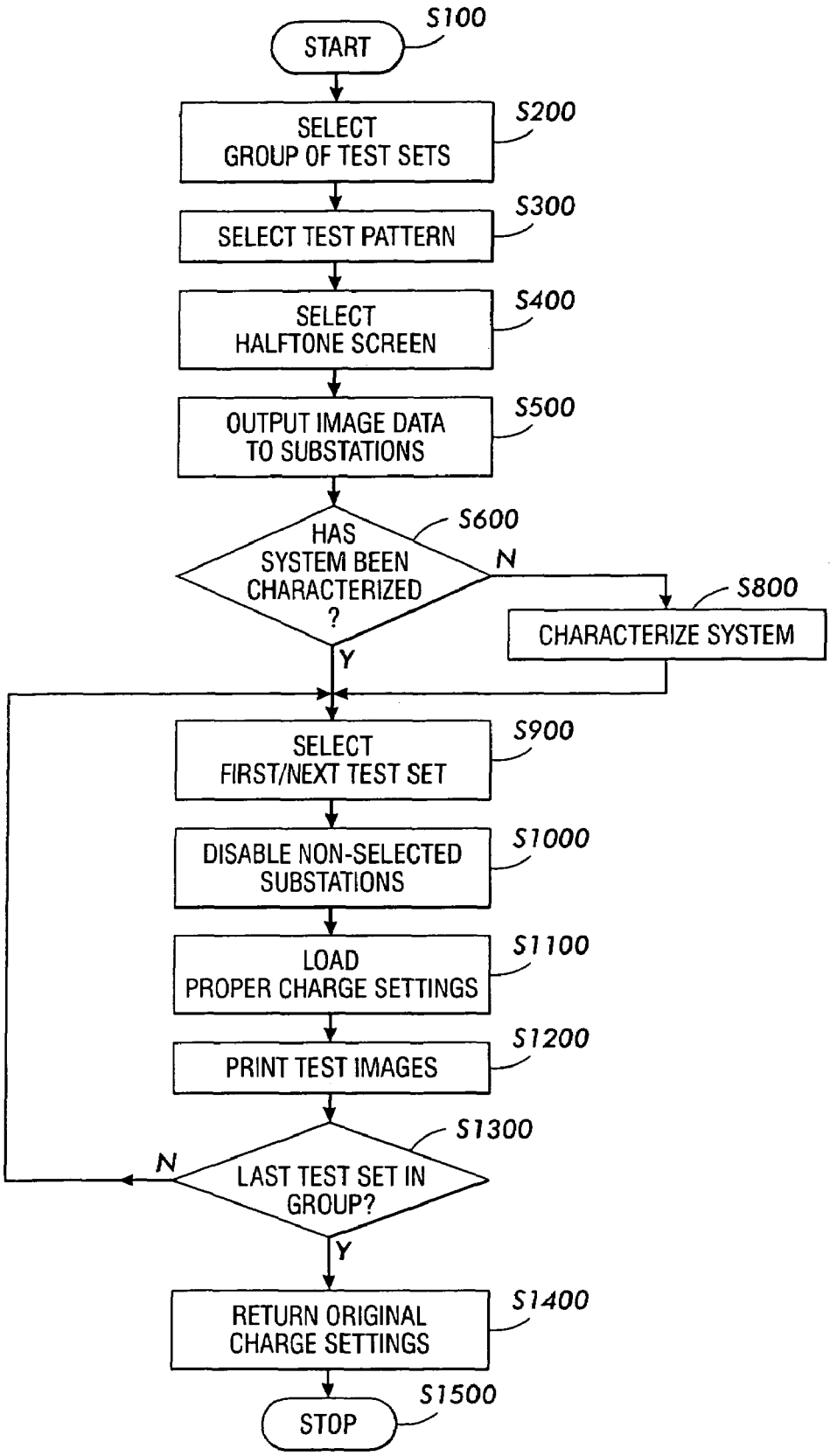
FIG. 3 is a flowchart outlining one exemplary embodiment of a diagnostic procedure, according to this invention.

FIG. 3 is a flowchart outlining one exemplary embodiment of a method for diagnosing a color uniformity problem, according to this invention. As shown in FIG. 3, operation of the method begins in step S100 and continues to step S200, where a group of test sets is selected. Next, in step S300, the test pattern to be used to print the test images is selected. Next, in step S400, the halftone screen is selected. The halftone screen is a matrix of dots at a specified resolution, measured in lines per inch or dots per inch. The higher the resolution the better the resulting image will appear, as the higher resolutions will appear smoother and the dot structure will be less apparent. Operation then continues to step S500. In step S500, the image data files are output to the selected exposing substations, based on the choice of test pattern and halftone screen.

Next, in step S600, a determination is made whether a system characterization has been performed. In various exemplary embodiments, the system may be queried to see if the system characterization has been performed during the current diagnostic session, or has been completed during a previous time period, for example within the last 30 minutes. If the system characterization has not been performed, operation of the method proceeds to step S800. Otherwise, operation jumps directly to step S900.

In step S800, the system characterization is performed. Next, in step 900, the first or next test set is selected from the group. Then, in step S1000, the unused substations are disabled based on the selected test set. Operation then continues to step S1100.

In step S1100, an appropriate charge setting is applied to the charge station to set the grid voltage of the charging substation of the current test set. The charge settings may be those just determined in the system characterization performed in step S800, or they may have been previously determined. Then, in step S1200, a predetermined number of test images are produced by the image-forming path defined by the test set selected, using this value for the charge setting. In one exemplary embodiment, ten test images are produced by each test set in the group. Next, in step S1300, a determination is made whether the last selected test set in the group has been used. If so, operation jumps to step S1400. Otherwise, operation returns to step S900. In step S1400, the normal operating charge settings are re-loaded into the charging substations. Operation then continues to step S1500, where operation of the method ends.

It should be appreciated that in step S200, the group of selected test sets may include diagnostic test sets, chosen to eliminate the substation suspected of causing the color non-uniformity problem, as well as confirmation test sets, chosen to intentionally include the suspected faulty device in the image-forming path. The presence of the image defect in the test images produced by the confirmation test sets, confirms that the faulty device has been correctly identified.

Figure 4:
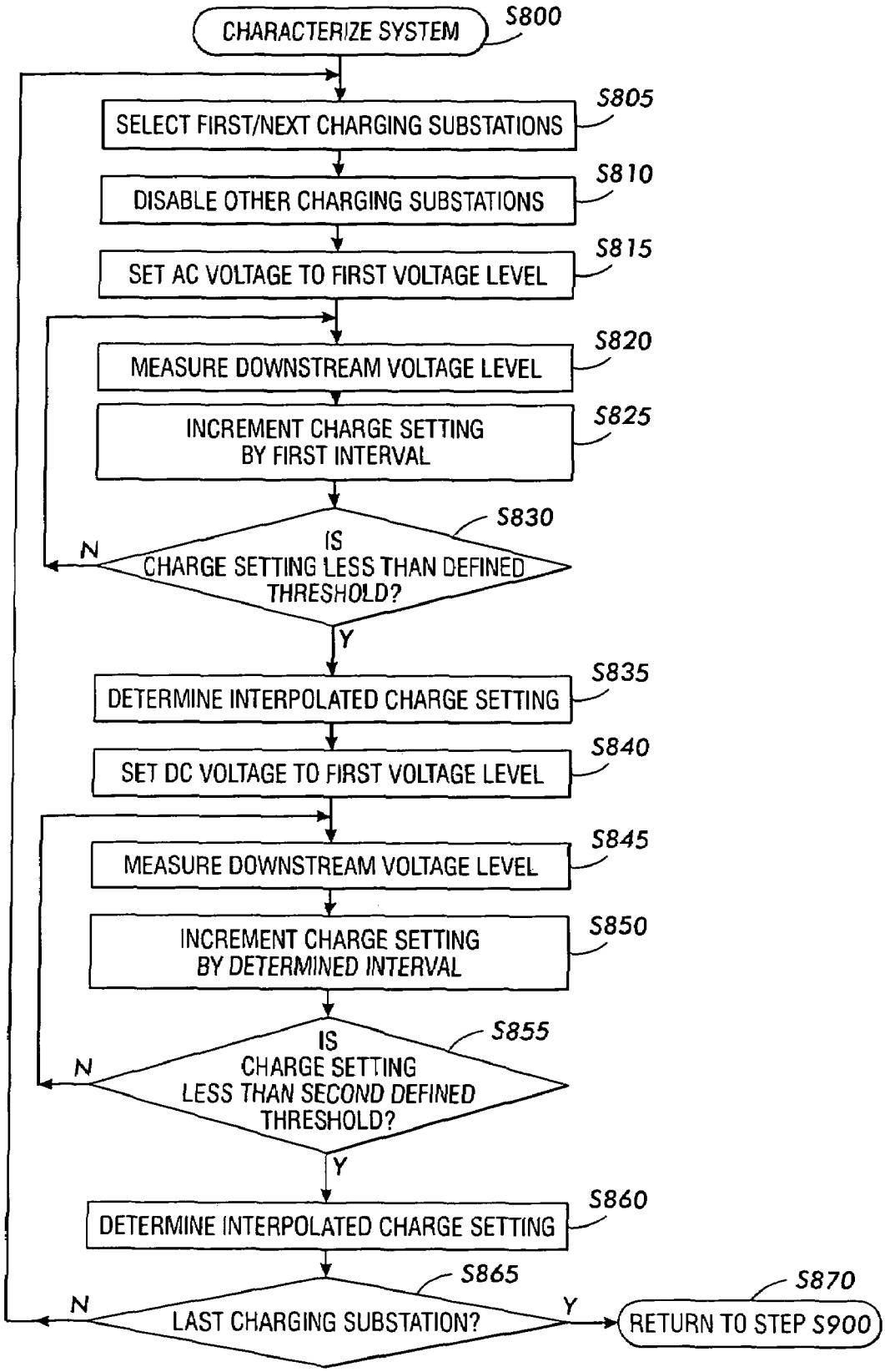
FIG. 4 is a flowchart outlining in greater detail one exemplary embodiment of a diagnostic procedure according to this invention.

FIG. 4 is a flowchart outlining in greater detail one exemplary embodiment of the method for characterizing the system. Characterizing the system is used to determine the appropriate charge setting for a given test set to be used with a charging substation to obtain a desired electrostatic voltage remaining on the photoreceptor belt at whatever developing substation is indicated by the test set. As shown in FIG. 4, operation of the method begins in step S800, and continues to step S805, where a first or next charging substation is selected. Then, in step S810, the other charging substations are disabled. Next, in step S815, the AC charge setting of the first selected substation is set to a first voltage level, such as, for example, 200 V. Operation then continues to step S820.

In step S820, the downstream electrostatic voltage on the charge-retentive surface is measured at a location downstream from the selected charging substation. In various exemplary embodiments, the voltage is measured at each downstream developing substation, so that the dark decay for each relevant test set can be characterized. For example, if the first charging substation 221 is being evaluated, the voltage is measured at each of the downstream developing substations 233, 243, 253, and 263. Next, in step S825, the charge setting for the current charging substation is incremented by a first defined interval. In various exemplary embodiments, the charge setting is incremented by 200 V. Then, in step S830, a determination is made whether the increased charge setting exceeds a defined threshold. In various exemplary embodiments, the defined threshold is 1000 V. If the charge setting does not yet exceed this defined threshold, operation returns to step S820. Otherwise, operation continues to step S835.

In step S835, an interpolated value for the charge setting for the current charging substation relative to one or more of the downstream developing substations is determined based on the measurements taken at each of the downstream developing substations for which measurements were taken, for the different charge setting values. Next, in step S840 in FIG. 4, a DC charge setting is set to a first voltage level. Then, in step S845, the downstream voltage levels are measured. In various exemplary embodiments, the first voltage level for the DC charge setting may be 200 V. Operation then continues to step S850.

In step S850, the DC charge setting is incremented by a second defined interval. In various exemplary embodiments, this second defined interval is 200 V. Then, in step S855, a determination is made whether the incremented charge setting exceeds a second defined threshold. In various exemplary embodiments, the defined threshold is 1000 V. If not, operation returns to step S845. Otherwise, operation continues to step S860, where, for each downstream developing substation, the interpolated value of the charge setting that produces the desired target voltage for that downstream developing substation is determined based on the previous measurements. The interpolated value may be stored in memory for later use. Operation then continues to step S865.

In step S865, a determination is made whether the last charging substation has been evaluated. If so, operation continues to step S870, where operation of the method returns to step S900. If the last charging substation has not yet been evaluated, operation returns to step S805.

It should be appreciated that, in step S835, the interpolated value of the charge setting is the charge setting which is desirably applied to the grid of the current charging substation, to obtain a target voltage on the photoreceptor belt at the location of the corresponding developing substation. For example, if a given voltage on the charge-retentive surface is desired at the developing substation 233, for example, as a result of charging at the charging substation 221, the charge setting which should be applied to the grid of the charging substation 221, is that which results in the desired voltage at the developing substation 233, interpolated based on the previous measurements of the voltage at the developing substation 233 for the various charge settings. This interpolated value may then be stored for later use.

For a first pass through the method outlined in FIG. 4, using the first charging substation, four interpolated charge settings will result from the measurements, one for each of the four downstream developing substations. For subsequent passes through the method, fewer interpolated charge settings will be determined, because there are fewer downstream developing stations. For example, on the second pass, the second charging substation is selected (such as, for example, substation 231 shown in FIG. 2), and voltage measurements will be taken at three downstream substations (such as, for example, the substations 243, 253 and 263 shown in FIG. 2).

It should be appreciated that, for the image forming devices 100 and 200 shown in FIGS. 1 and 2, in various exemplary embodiments, ten interpolated AC charge setting values are obtained in step S800, one for each possible combination of a charge substation with a downstream developing substation: the charging substation 221 with the developing substations 233, 243, 253, and 263; the charging substation 231 with the developing substation 243, 253, and 263; the charging substation 241 with the developing substations 253 and 263; and the charging substation 251 with the developing substation 263. Similarly, in various exemplary embodiments, ten interpolated DC charge setting values are obtained in step S800, one for each possible combination of a charge substation with a downstream developing substation.

Therefore, in the exemplary embodiment described here, the voltage is measured at each downstream developing substation after setting the charge setting of the charging substation. In various other exemplary embodiments however, the voltage may be measured only at the developing substation that is to be used by the selected test set.

While this invention has been described in conjunction with the exemplary embodiments outlined above, it is evident that many alternatives, modifications and variations will be apparent to those skilled in the art. In particular, the procedure has been described with the voltage measurements being taken at the developing substation. However, it should be clear to one skilled in the art that the procedure can also be applied to measurements taken at the exposing substation. Accordingly, the exemplary embodiments of the invention as set forth above are intended to be illustrative, not limiting. Various changes may be made without departing from the spirit and scope of the invention as defined in the following claims.

What is claimed is:

1. A method for identifying at least one cause of a color uniformity problem in an image-forming device having at least a first print station and a second print station downstream of the first print station, where each print station includes a charging substation, an exposing substation and a developing substation, the method comprising:

selecting at least a first substation from the charging substation and exposing substation of the first print station;

selecting at least a second substation from one of the exposing substation and developing substation of the second print station;

adjusting a setting on the first substation, based on an interval between the first substation and the second substation;

disabling at least some non-selected substations of the image-forming device; and generating a test image using the selected substations, wherein a cause of the color uniformity problem can be identified from the test image based on the selected substations used to form the test image.

2. The method according to claim 1, wherein the first substation is a charging substation and second substation is one of the exposing station and the developing substation.

3. The method of claim 2, further comprising:

selecting a third substation from the first or second print stations, or from a third print station, wherein the third substation is an exposing substation.

4. The method of claim 3, further comprising:

disabling the substations that were not selected; and generating test images indicative of a color uniformity problem caused by the first, second or third print station.

5. The method according to claim 1, further comprising adjusting a charge setting on the first substation to compensate for a variable interval between the first substation and the second substation.

6. The method according to claim 5, further comprising determining an amount of adjustment to the charge setting by measuring a voltage on a charge-retentive surface of the image-forming device resulting from the first substation.

7. The method according to claim 6, wherein determining the amount of adjustment comprises:

determining an amount of adjustment to an AC charge setting; and determining an amount of adjustment to a DC charge setting.

8. The method according to claim 6, wherein determining the amount of adjustment comprises:

measuring a plurality of voltages corresponding to a plurality of charge settings; and linearly interpolating between the plurality of charge settings to determine a desired charge setting to be applied to produce a target voltage.

9. The method according to claim 8, wherein measuring the plurality of electrostatic voltages corresponding to a plurality of charge settings comprises measuring the plurality of electrostatic voltages at settings between about 200 volts and about 1000 volts.

10. The method according to claim 9, wherein the plurality of voltages is measured at each of the developing substations downstream from the charging substation.

11. The method according to claim 10, wherein determining the amount of adjustment is based on which downstream developing substation is chosen as the second substation.

12. The method according to claim 10, wherein determining the amount of adjustment is based on which downstream exposing substation is chosen as the second substation.

13. The method according to claim 9, wherein the plurality of voltages is measured at each of the exposing substations downstream from the charging substation.

14. A method for identifying at least one cause of a color uniformity problem in an image-forming device, comprising:

choosing at least one test set, each test set identifying a charging substation from a first print station, an exposing substation from the first print station or a second print station, and a developing substation from the second print station or a third print station;

adjusting a charge setting on the identified charging substation, based on an interval between the identified charging substation and the identified developing substation; and generating, for each test set, a plurality of test images that are indicative of a color uniformity problem caused by one of the selected substations.

15. The method of claim 14, further comprising choosing at least additional one test set to determine that the cause of a color uniformity problem as being one of the non-identified substations.

16. The method of claim 14, wherein adjusting the charge settings comprises measuring an electrostatic voltage on a charge-retentive surface resulting from the charging substation.

17. The method of claim 14, wherein adjusting the charge settings comprises at least one of adjusting an AC charge setting and adjusting a DC charge setting.

18. The method of claim 14, wherein adjusting the charge settings comprises:

measuring a plurality of electrostatic voltages corresponding to a plurality of charge settings; and linearly interpolating a correct charge setting to be applied to produce a target electrostatic voltage.

19. The method of claim 18, wherein measuring the plurality of electrostatic voltages corresponding to a plurality of charge settings comprises measuring the plurality of electrostatic voltages at settings between about 200 volts and about 1000 volts.

20. The method of claim 18, wherein measuring the plurality of electrostatic voltages comprises measuring the plurality of electrostatic voltages at each of the developing substations downstream from the charging substation.

21. The method of claim 14, wherein adjusting the charge settings comprises adjusting the charge settings based on which print station the developing substation is chosen from.

22. A method for determining a charge setting for a charging substation in an image-forming device and usable obtain a target charge on a downstream substation that is located in a different print station than the print station that the charging substation is located in, comprising:

applying at the charging substation a charge to a charge-retentive surface of the image-forming device;

measuring at the downstream developing substation a voltage on the charge-retentive surface of the image-forming device resulting from a charge delivered at the charging substation;

incrementing the charge setting on the charge setting device;

repeating at least the applying and measuring steps for at least one incremented charge setting; and determining, based on the measured voltages on the charge-retentive surface of the image-forming device resulting from the charges delivered at the charging substation for the plurality of charge settings, a charge setting that results in the target voltage at the developing substation.

23. The method according to claim 22, wherein determining the charge setting comprises:

determining a setting for an AC charging device; and determining a setting for a DC charging device.

24. The method according to claim 22, wherein determining, based on the measured voltages on the charge-retentive surface of the image-forming device resulting from the charges delivered at the charging substation for the plurality of charge settings, the charge setting that results in the target voltage at the developing substation comprises linearly interpolating between the plurality of measured voltages to determine a desired charge setting to be applied to produce the target voltage.

25. A storage medium storing a set of program instructions executable on a data processing device and usable to identify at least one cause of a color uniformity problem in an image-forming device having at least a first print station and a second print station downstream of the first print station, where each print station includes a charging substation, an exposing substation and a developing substation, the set of program instructions comprising:

instructions for selecting at least a first substation from the charging substation and exposing substation of the first print station;

instructions for selecting at least a second substation from one of the exposing substation and developing substation of the second print station;

instructions for adjusting a setting on the first substation based on an interval between the first substation and the second substation;

instructions for disabling at least some non-selected substations of the image-forming device; and instructions for generating a test image using the selected substations, wherein a cause of the color uniformity problem can be identified from the test image based on the selected substations used to form the test image.

26. The storage medium according to claim 25, wherein the first substation is a charging substation and second substation is one of the exposing station and the developing substation.

27. The storage medium of claim 26, further comprising:

instructions for selecting a third substation from the first or second print stations, or from a third print station, wherein the third substation is an exposing substation.

28. The storage medium of claim 27, further comprising:

instructions for disabling the substations that were not selected; and instructions for generating test images indicative of a color uniformity problem caused by the first, second or third print station.

29. The storage medium according to claim 25, further comprising instructions for adjusting a charge setting on the first substation to compensate for a variable interval between the first substation and the second substation.

30. The storage medium according to claim 29, further comprising instructions for determining an amount of adjustment to the charge settings by measuring a voltage on a charge-retentive surface of the image-forming device resulting from the first substation.

31. The storage medium according to claim 30, wherein the instructions for determining the amount of adjustment comprise:

instructions for determining an amount of adjustment to an AC charge setting; and instructions for determining an amount of adjustment to a DC charge setting.

32. The storage medium according to claim 30, wherein the instructions for determining the amount of adjustment comprise:

instructions for measuring a plurality of voltages corresponding to a plurality of charge settings; and instructions for linearly interpolating between the plurality of charge settings to determine a desired charge setting to be applied to produce a target voltage.

33. The storage medium according to claim 32, wherein the instructions for measuring the plurality of electrostatic voltages corresponding to a plurality of charge settings comprise instructions for measuring the plurality of electrostatic voltages at settings between about 200 volts and about 1000 volts.

34. The storage medium according to claim 33, wherein the plurality of voltages is measured at each of the developing substations downstream from the charging substation.

35. The storage medium according to claim 34, wherein the instructions for determining the amount of adjustment is based on which downstream developing substation is chosen as the second substation.

36. The storage medium according to claim 34, wherein the instructions for determining the amount of adjustment is based on which downstream exposing substation is chosen as the second substation.

37. The storage medium according to claim 33, wherein the plurality of voltages is measured at each of the exposing substations downstream from the charging substation.

38. A storage medium storing a set of program instructions executable on a data processing device and usable to identify at least one cause of a color uniformity problem in an image-forming device, the set of program instructions comprising:

instructions for choosing at least one test set, each test set identifying a charging substation from a first print station, an exposing substation from the first print station or a second print station, and a developing substation from the second print station or a third print station;

instructions for adjusting a charge setting on the identified charging substation, based on an interval between the identified charging substation and the identified developing substation; and instructions for generating, for each test set, a plurality of test images that are indicative of a color uniformity problem caused by one of the selected substations.

39. The storage medium of claim 38, further comprising instructions for choosing at least one additional test set to determine that the cause of a color uniformity problem as being one of the non-identified substations.

40. The storage medium of claim 38, wherein the instructions for adjusting the charge settings comprise instructions for measuring an electrostatic voltage on a charge-retentive surface resulting from the charging substation.

41. The storage medium of claim 38, wherein the instructions for adjusting the charge settings comprise at least one of instructions for adjusting an AC charge setting and instructions for adjusting a DC charge setting.

42. The storage medium of claim 38, wherein the instructions for adjusting the charge settings comprise:

instructions for measuring a plurality of electrostatic voltages corresponding to a plurality of charge settings; and instructions for linearly interpolating a correct charge setting to be applied to produce a target electrostatic voltage.

43. The storage medium of claim 42, wherein the instructions for measuring the plurality of electrostatic voltages corresponding to a plurality of charge settings comprise instructions for measuring the plurality of electrostatic voltages at settings between about 200 volts and about 1000 volts.

44. The storage medium of claim 42, wherein the instructions for measuring the plurality of electrostatic voltages comprise instructions for measuring the plurality of electrostatic voltages at each of the developing substations downstream from the charging substation.

45. The storage medium of claim 38, wherein the instructions for adjusting the charge settings comprise instructions for adjusting the charge settings based on which print station the developing substation is chosen from.

46. A storage medium storing a set of program instructions executable on a data processing device and usable to determine a charge setting for a charging substation in an image-forming device usable to obtain a target charge on a downstream substation that is located in a different print station than the print station that the charging substation is located in, the set of program instructions comprising:

instructions for applying at the charging substation a charge to a charge-retentive surface of the image-forming device;

instructions for measuring at the downstream developing substation a voltage on the charge-retentive surface of the image-forming device resulting from a charge delivered at the charging substation;

instructions for incrementing the charge setting on the charge setting device;

instructions for repeating at least the applying and measuring steps for at least one incremented charge setting; and instructions for determining, based on the measured voltages on the charge-retentive surface of the image-forming device resulting from the charges delivered at the charging substation for the plurality of charge settings, a charge setting that results in the target voltage at the developing substation.

47. The storage medium according to claim 46, wherein the instructions for determining the charge setting comprise:

instructions for determining a setting for an AC charging device; and instructions for determining a setting for a DC charging device.

48. The storage medium according to claim 46, wherein the instructions for determining, based on the measured voltages on the charge-retentive surface of the image-forming device resulting from the charges delivered at the charging substation for the plurality of charge settings, the charge setting that results in the target voltage at the developing substation comprise instructions for linearly interpolating between the plurality of measured voltages to determine a desired charge setting to be applied to produce the target voltage.

* * * * *